US008111831B2

(12) United States Patent
Asada et al.

(10) Patent No.: US 8,111,831 B2
(45) Date of Patent: Feb. 7, 2012

(54) ACOUSTIC APPARATUS, TIME DELAY COMPUTATION METHOD, AND RECORDING MEDIUM

(75) Inventors: Kohei Asada, Kanagawa (JP); Tetsunori Itabashi, Kanagawa (JP)

(73) Assignee: Sony Corporation (JP)

( * ) Notice: Subject to any disclaimer, the term of this patent is extended or adjusted under 35 U.S.C. 154(b) by 1338 days.

(21) Appl. No.: 11/410,881

(22) Filed: Apr. 25, 2006

(65) Prior Publication Data

US 2006/0256970 A1 Nov. 16, 2006

(30) Foreign Application Priority Data

Apr. 26, 2005 (JP) ..... 2005-127577

(51) Int. Cl.
*H04R 29/00* (2006.01)
*H04R 5/02* (2006.01)

(52) U.S. Cl. ..... 381/59; 381/56; 381/303

(58) Field of Classification Search ..... 381/59, 381/303, 304, 56, 305
See application file for complete search history.

(56) References Cited

U.S. PATENT DOCUMENTS 4,306,113 A 12/1981 Morton
2002/0062695 A1* 5/2002 Ohta ..... 73/645

FOREIGN PATENT DOCUMENTS

JP 6-337687 A 12/1994
JP 7-036474 A 2/1995
JP 7-072876 A 3/1995
JP 8-047099 A 2/1996
JP 10-248097 A 9/1998
JP 10-248098 A 9/1998
JP 2001-112100 A 4/2001
JP 2002-135897 A 5/2002
JP 2004-133671 A 4/2004

OTHER PUBLICATIONS

Office Action from Chinese Application No. 200610084154 dated Jul. 24, 2009.

* cited by examiner

*Primary Examiner* — Vivian Chin
*Assistant Examiner* — Douglas Suthers
(74) *Attorney, Agent, or Firm* — Lerner, David, Littenberg, Krumholz & Mentlik, LLP

(57) ABSTRACT

An acoustic apparatus includes a positive value conversion section configured to convert, into a positive value, a response signal obtained by collecting a test signal emitted from a speaker using a microphone; a detection section configured to detect a first transient response part that becomes a first mountain portion of the converted response signal; an estimation section configured to estimate a rise point of the converted response signal from at least N points that contain a peak position of the first transient response part or the vicinity thereof; and a computation section configured to compute a time delay of audio collected by the microphone based on the estimated rise point and on a timing at which the test signal is generated.

16 Claims, 15 Drawing Sheets

SIMPLE EXAMPLE 1 OF "RISE" ESTIMATION

20% OF A
TOP AMPLITUDE A
OF FIRST MOUNTAIN
40% OF A
AMPLITUDE
DARK NOISE OF PRE-MEASUREMENT SHOULD BE LOWER THAN OR EQUAL TO THIS LEVEL

20% OF A
TOP AMPLITUDE A
OF FIRST MOUNTAIN
40% OF A
AMPLITUDE
TIME

SIMPLE EXAMPLE 2 OF "RISE" ESTIMATION

TIME

ACOUSTIC APPARATUS, TIME DELAY COMPUTATION METHOD, AND RECORDING MEDIUM

CROSS-REFERENCE TO RELATED APPLICATIONS

The present application claims priority from Japanese Patent Application No. JP 2005-127577 filed on Apr. 26, 2005, the disclosure of which is hereby incorporated by reference herein.

BACKGROUND OF THE INVENTION

The present invention relates to an acoustic apparatus such as a stereo acoustic system and a multi-channel acoustic system, to a method for determining a time delay of a speaker used in the acoustic apparatus, and to a recording medium.

In content such as movies recorded on a DVD (Digital Versatile Disc) and in digital television broadcast, so-called multi-channel audio data, such as a 5.1 channel and a 7.1 channel, has come to be handled, and the number of chances for a user to set a multi-channel listening system, such as a 5.1 channel and a 7.1 channel, has increased.

For example, a listening system of a 5.1 channel is formed of six audio channels: a front left channel, a front center channel, a front right channel, a back left channel, a back right channel, and a subwoofer channel, and can play back audio by using six speakers corresponding to the six audio channels. The expression [0.1] in the 5.1 channel means a subwoofer channel for compensating for low frequency components.

In a multi-channel listening system, since a plurality of speakers are used, there are cases in which a playback sound field that is formed by the multi-channel listening system does not become an appropriate one as a result of being affected by a distance between each speaker and a user, by output characteristics of each speaker, by an obstacle that exists between the speaker and the user, etc., at a position where the user listens to audio emitted from each speaker. For example, the following occurs: a sound image that should be localized at the front center is offset to the right side or to the left side.

For this reason, some multi-channel listening Systems are provided with a so-called time alignment function capable of forming an appropriate playback sound field by appropriately delaying audio emitted from each speaker. For example, a listening system 100 having a time alignment function for a speaker, shown in FIG. 15, is provided.

The listening system 100 shown in FIG. 15 allows a digital amplifier 102 to perform DAC (Digital-Analog Convert) playback of a signal for measuring a time-stretched pulse (TSP) (signal in which the energy of an impulse signal is distributed in a time axis), which is generated in a TSP signal generation section 101, and allows this signal to be emitted from a target speaker among speakers SP1 to SP5.

The TSP measurement signal emitted in this manner is collected by a microphone MC, which is arranged at a listening position selected by the user, is amplified and converted into a digital signal by a microphone amplifier+ADC (Analog-Digital Converter) 103. This signal is analyzed by a signal analysis section 104 in order to determine an impulse response.

On the basis of the determined impulse response, the time at which audio emitted from each speaker arrives at the target listening position is determined, and the delay time of the audio to be supplied to the speaker is adjusted for each speaker so that the audio from each speaker can be listened to by the user at the same timing. Thus, the optimal playback sound field corresponding to the listening position can be easily and correctly formed.

A technology used for emitting test sound from a speaker, for collecting this sound by a microphone arranged at a predetermined position, and for obtaining an impulse response as in the above-described listening system has been widely used when so-called time alignment of speakers is performed in, for example, acoustic processing apparatuses disclosed in Japanese Unexamined Patent Application Publication Nos. 10-248097 and 10-248098 (to be described later).

However, an impulse response of a subwoofer having a band of ultra-low frequencies to low frequencies among impulse responses of a plurality of speakers used to form a playback sound field with a sense of realism takes a long time until it is converged due to influences of reflection in a wall and standing waves in the case of, in particular, a room of a household. Therefore, there is a possibility that the measurement time becomes long and memory is pressed in the meaning of system implementation.

More specifically, in a multi-channel listening system, if the time delay of audio from a subwoofer speaker is to be correctly measured, problems may occur in the aspect of a processing time and manufacturing cost, such as taking a long time, and a memory having a large storage capacity for the detection of processing becoming necessary.

In view of the above, it is preferable to quickly and accurately detect a time delay with respect to audio from a speaker for low audio frequencies, such as a woofer and a subwoofer, without using a large-capacity memory.

SUMMARY OF THE INVENTION

According to an embodiment of the present invention, there is provided an acoustic apparatus including positive value conversion means for converting, into a positive value, a response signal obtained by collecting a test signal emitted from a speaker using a microphone; detection means for detecting a first transient response part that becomes a first mountain portion of the converted response signal; estimation means for estimating a rise point of the converted response signal from at least N points that contain a peak position of the first transient response part or the vicinity thereof; and computation means for computing a time delay of audio collected by the microphone based on the estimated rise point and on a timing at which the test signal is generated.

In the acoustic apparatus according to an embodiment of the present invention, a test signal emitted from a speaker may be collected by a microphone and may be made to be a response signal. This signal may be converted into a positive value by positive value conversion means. A first transient response part, which is a first mountain portion of the response signal that is converted into a positive value, may be detected by detection means, this first transient response part may be used as a reference, and the rise point of the converted response signal may be estimated by estimation means. Then, on the basis of the estimated rise point, the time delay of the target speaker may be computed.

As a result, it becomes possible to quickly and accurately determine a time delay of audio emitted from, in particular, a speaker for low audio frequencies without providing a large memory for storing a response signal.

DETAILED DESCRIPTION

With reference to the drawings, a description will now be given of an apparatus, a method, and a recording medium according to embodiments of the present invention. In the embodiments to be described below, a description will be given by using as an example a case in which the present invention is applied to a playback apparatus capable of playing back multi-channel audio signals recorded on an optical disc recording medium, such as a DVD (Digital Versatile Disc) (hereinafter referred to simply as an "optical disc").

The playback apparatus according to an embodiment of the present invention to be described below is able to measure a spatial delay that occurs in a distance from a speaker to a microphone installed at a listening position for the purpose of adjusting time alignment of the speaker in a multi-channel playback environment. However, the present invention that is applied to the playback apparatus of the embodiment to be described below is effective for use with, in particular, speakers for low audio frequencies, which are called a subwoofer and a woofer, whose impulse response tends to take time. For this reason, in the following, a description will be given specifically of a case in which time alignment is performed on a speaker for low audio frequencies, which is called a subwoofer or a woofer (hereinafter referred to simply as a "woofer").

The present invention that is applied to the playback apparatus according to this embodiment can also be applied to an ordinary speaker other than a woofer, such as a tweeter. However, usually, with respect to a speaker for high audio frequencies, such as a tweeter, whose impulse response does not take time, a spatial delay can be measured more accurately by using a method for measuring a spatial delay using an impulse response, which is disclosed in Japanese Patent Application No. 2004-133671 applied for patent earlier.

In the case of an ordinary speaker, the measurement of a spatial delay is equivalent to the measurement of the amount of delay that mainly occurs depending on the distance between a speaker and a microphone installed at a listening position, that is, equivalent to the measurement of the distance between a speaker and a microphone. However, when a woofer is targeted, the delay in a filter provided at a stage prior to the woofer is often larger in comparison with an ordinary speaker.

As a consequence, in the playback apparatus of the embodiment to be described below, a delay that should be corrected using time alignment is a time delay in which a spatial delay and an electrical delay dependent on a speaker system are combined (hereinafter referred to as a "woofer time delay"). The playback apparatus of the embodiment to be described below is designed so that the woofer time delay can be measured and corrected by time alignment.

[Configuration and Basic Operation of Playback Apparatus]

Figure 1:
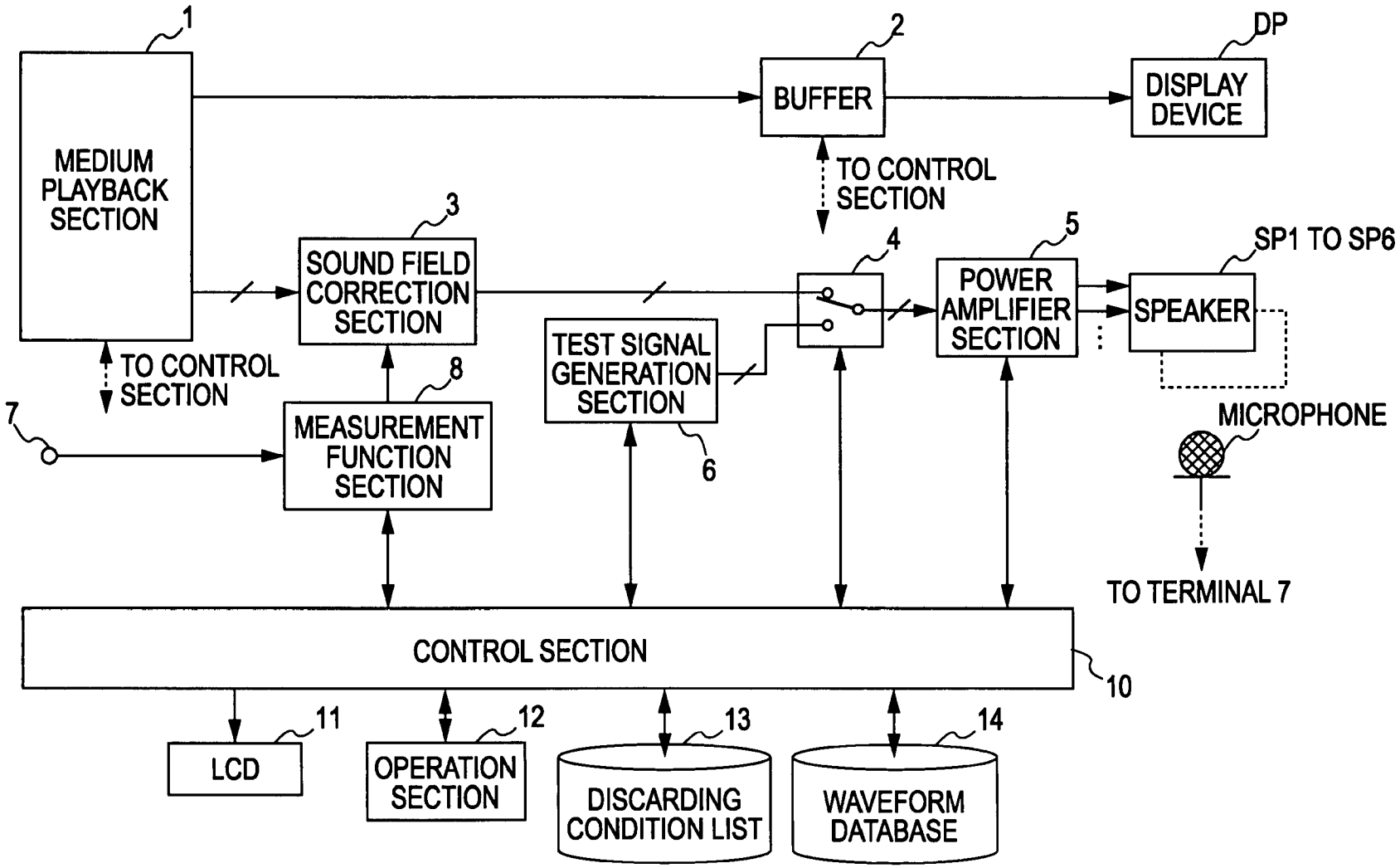
FIG. 1 is a block diagram illustrating a playback apparatus to which an embodiment of the present invention is applied.

First, the configuration and the basic operation of the playback apparatus of this embodiment will be described. FIG. 1 is a block diagram illustrating a playback apparatus of this embodiment. The playback apparatus of this embodiment can play back, for example, a multi-channel audio signal of a 5.1 channel. As shown in FIG. 1, the playback apparatus of this embodiment includes a medium playback section 1, a frame buffer 2, a sound field correction section 3, a switch circuit 4, a power amplifier section 5, a test signal generation section 6, a connection terminal 7 of a microphone, a measurement function section 8, a control section 10, an LCD (Liquid Crystal Display) 11, and an operation section 12.

As shown in FIG. 1, a display device DP is connected to the playback apparatus of this embodiment via the frame buffer 2, and speakers SP1 to SP6 are connected thereto via the power amplifier section 5 in such a manner as to correspond to each 5.1 channel. Furthermore, a microphone MC is connected to the connection terminal 7 of the microphone.

The control section 10 controls each section of the playback apparatus of this embodiment. Although not shown, the control section 10 is configured as a microcomputer including a CPU (Central Processing Unit), and non-volatile memories, such as a ROM (Read Only Memory), a RAM (Random Access Memory), and an EEPROM (Electrically Erasable and Programmable ROM).

As is also shown in FIG. 1, the LCD 11 and the operation section 12 are connected to the control section 10. The LCD 11 has a comparatively large display screen, and can display various kinds of information, such as a guidance message, a warning message, and a status display, on the basis of information from the control section 10.

The operation section 12 includes an on/off key of the power source, a playback key, a pause key, a fast-forward key, a fast-rewind key, and other various kinds of operation keys. The operation section 12 accepts an operation input from a user, converts this input into an electrical signal, and supplies this signal to the control section 10. As a result, the control section 10 can control each section on the basis of an operation input from the user.

In this embodiment, a discarding condition list 13 and a waveform database 14 are connected to the control section 10. As will be described later, they store discarding condition information and rise point information that are used when a woofer time delay is to be determined.

Although not shown, the medium playback section 1 includes a loading section for an optical disc such as a DVD; a rotational driving section for an optical disc, having a spindle motor and the like; an optical pickup section having an optical system, such as a laser light source, an objective lens, a 2-axis actuator, a beam splitter, a photo detector and the like; a sled motor for moving the optical pickup section in the radial direction of the optical disc; and various kinds of servo circuits, and also includes a video decoder and an audio decoder.

When a playback instruction is accepted via the operation section 12, the control section 10 controls each section, so that a process for playing back content recorded on an optical disc loaded into the medium playback section 1 is started. It is assumed here that the medium loaded into the medium playback section 1 is a DVD and that content recorded thereon is content of a movie formed of audio data of a 5.1 channel and video data.

In this case, under the control from the control section 10, the medium playback section 1 rotationally drives the loaded DVD, reads control data, audio data, video data and the like, which are recorded on the DVD, by radiating laser light onto the DVD and by receiving the reflected light, and separates various kinds of these pieces of data. The control data within the separated data is supplied to the control section 10 so that the control data can be used to control each section.

Both the separated audio data and the video data are subjected to data compression and are recorded on a DVD. Therefore, the medium playback section 1 performs a decoding process on the read audio data and the video data in order to reconstruct the audio data and the video data before data compression. The reconstructed video data is supplied to the display device DP via the frame buffer 2.

The frame buffer 2 is such that writing/reading of video data is controlled by the control section 10, and is used to temporarily store video data in frame units in order to overcome deviation of so-called rip sync. That is, as will be described later, processing takes time because a sound field correction process or the like is performed on audio data, and a time lag occurs between the playback of the audio data and the playback of the video data. Therefore, in order to overcome this time lag, the frame buffer 2 is provided, so that the playback timing of the video data is synchronized with the playback timing of the audio data, and thus deviation of a rip sync does not occur.

The display device DP includes, for example, a display element having a comparatively large screen, such as an LCD, a PDP (Plasma Display Panel), an organic EL (Electro Luminescence) display, or a CRT (Cathode-Ray Tube). The display device DP forms an analog video signal for display from the video data supplied via the frame buffer 2, and allows the display screen of its own display element to display a video on the basis of this analog video signal.

As a result, the video based on the video data that is played back by the medium playback section 1 is displayed on the display screen of the display element of the display device DP, so that the user can view this video.

On the other hand, in the medium playback section 1, the audio data that is separated and decoded is further separated into audio data of each audio channel of a 5.1 channel. The audio data of each audio channel is supplied to the sound field correction section 3. The sound field correction section 3 can individually perform processing on each piece of audio data of each audio channel of the 5.1 channel from the medium playback section 1, and includes a delay processing section, a sound quality adjustment section, and a gain adjustment section in such a manner as to correspond to each audio channel.

The sound field correction section 3 is designed to be able to form a correct sound field when a delay process, a sound quality adjustment process, a gain adjustment process, etc., are performed on the audio data of each audio channel, which is supplied to the sound field correction section 3, on the basis of an instruction parameter from the measurement function section 8 (to be described later) and audio based on the audio data is emitted from each of the speakers SP1 to SP6 (to be described later).

The audio data of each audio channel, which is processed by the sound field correction section 3, is supplied to the power amplifier section 5 via the switch circuit 4. Each of the switch circuit 4 and the power amplifier section 5 can also deal with the audio data of a 5.1 channel. That is, during the playback process, the switch circuit 4 is switched to the sound field correction section 3 side under the control of the control section 10, and supplies the audio data of each audio channel from the sound field correction section 3 to the power amplifier section 5 at a subsequent stage.

The power amplifier section 5 also includes an amplification processing section corresponding to each audio channel, converts the audio data of each audio channel into an analog audio signal under the control of the control section 10, amplifies the level of the analog audio signal to an indicated level, and thereafter supplies the analog audio signal to the corresponding speakers SP1 to SP6.

As a result, audio based on the audio data of each audio channel, which is played back by the medium playback section 1, is emitted from the corresponding speaker among the speakers SP1 to SP6, and the user can listen to this audio.

Furthermore, in the multi-channel acoustic system, there are cases in which it is difficult to form a satisfactory sound field as a result of being affected by the relationship between the installation position of each of a plurality of speakers and a listening position at which the user listens to audio emitted from each speaker, by the presence or absence of obstacles that obstruct the propagation of audio, and by differences in acoustic characteristics of the plurality of speakers.

That is, in the playback apparatus of this embodiment, a time difference occurs between speakers in the sound that arrives at the listening position from each of the speakers SP1 to SP6, and a difference occurs in sound quality and sound volume (level) between speakers that should correspond to each other. As a result, audio emitted from each of the speakers SP1 to SP6 is listened to individually and independently. Therefore, there are cases in which it is difficult to form an intended satisfactory sound field.

For this reason, in the playback apparatus of this embodiment, when sound field correction is instructed to be performed via the operation section 12, the control section 10 controls the test signal generation section 6, the measurement function section 8, and the like so that sound field correction is performed.

In the playback apparatus of this embodiment, when a time delay with respect to a woofer (woofer time delay) is to be measured, if an impulse response is to be used, it takes time until the impulse response is converged. Thus, the measurement takes time, and a memory having a large storage capacity becomes necessary.

For this reason, in the playback apparatus of this embodiment, when measuring the woofer delay time, an impulse response is not used, but a burst signal formed of continuous sine waves is used as a test signal. That is, when a sound field correction process is to be performed, under the control of the control section 10, the test signal generation section 6 generates a burst signal of a sine wave, sends out this signal to the audio channel to which the woofer is connected, and allows audio based on the target test signal to be emitted from the woofer.

The test signal emitted from this woofer is collected by the microphone MC, this signal is supplied, as a response signal with respect to the test signal, to the measurement function section 8, the rise point of the target response signal is specified, and on the basis of this specified rise point, the woofer time delay can be determined. On the basis of this woofer time delay, the measurement function section 8 can set an appropriate parameter to the delay circuit of the audio channel to which the woofer of the sound field correction section 3 is connected.

With respect to an audio channel to which a speaker other than a woofer is connected, as is also described above, by using a method for measuring a spatial delay by using an impulse response, which is disclosed in Japanese Patent Application No. 2004-133671 applied for patent earlier, a spatial delay is accurately measured, and on the basis of this delay, the amount of delay with respect to the target audio channel is determined. Then, a parameter based on this amount is formed and can be supplied to the sound field correction section 3. Furthermore, the measurement function section 8 is designed to form parameters for sound quality adjustment and gain adjustment on the basis of the test signal emitted from each speaker and to supply these parameters to the sound field correction section 3.

As is also described above, the sound field correction section 3 is configured to include a delay processing section, a sound quality adjustment section, and a gain adjustment section for each audio channel. The sound field correction section 3 sets, into the corresponding processing section, each parameter for the delay time, the sound quality adjustment information, and the level adjustment information with respect to each audio channel from the measurement function section 8, and performs a delay process, sound quality adjustment, and gain adjustment on the audio of each audio channel.

As described above, a correct sound field corresponding to the listening position can be formed by the functions of the measurement function section 8 and the sound field correction section 3. In particular, with respect to the woofer, by performing the measurement of a woofer time delay using a burst signal, it is possible to quickly and accurately determine the amount of delay with respect to the audio channel to which the woofer is connected without burdening the apparatus.

[Configuration and Operation of the Measurement Function Section]

Figure 2:
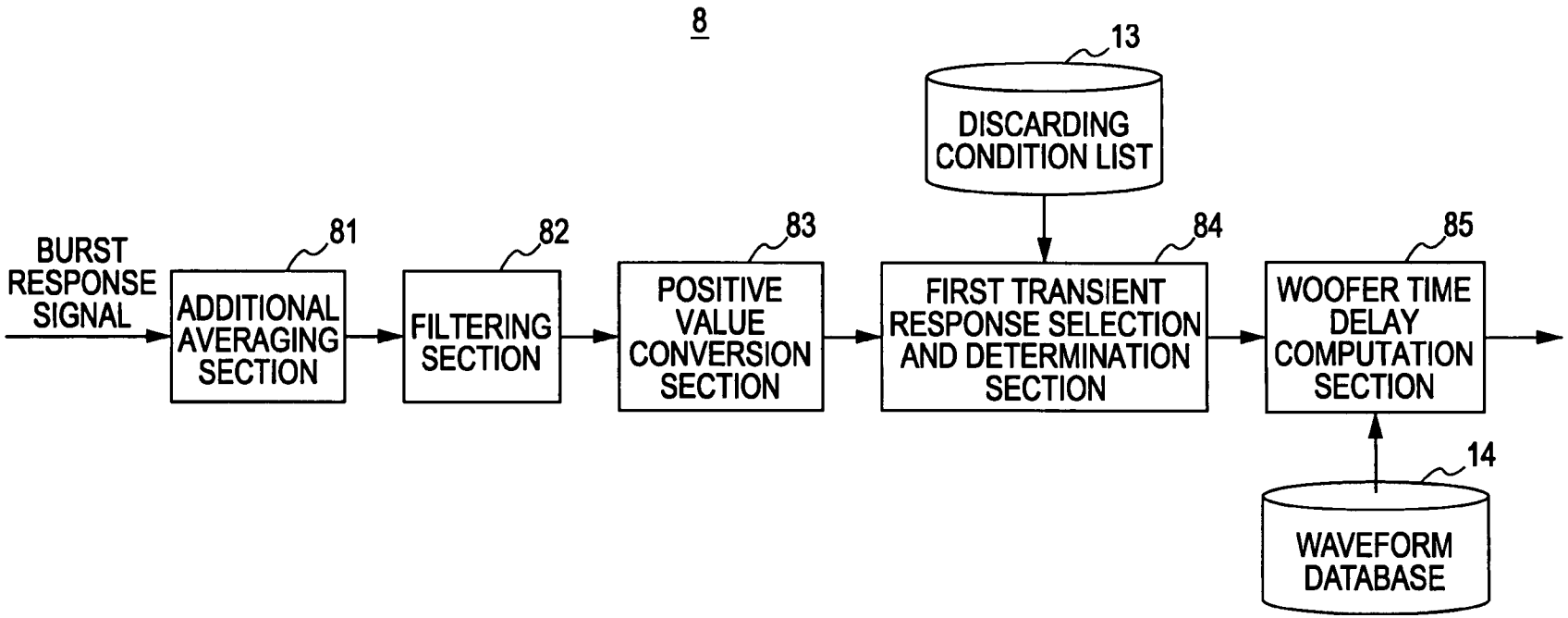
FIG. 2 is a block diagram illustrating a measurement function section 8 of the playback apparatus shown in FIG. 1.
Figure 3:
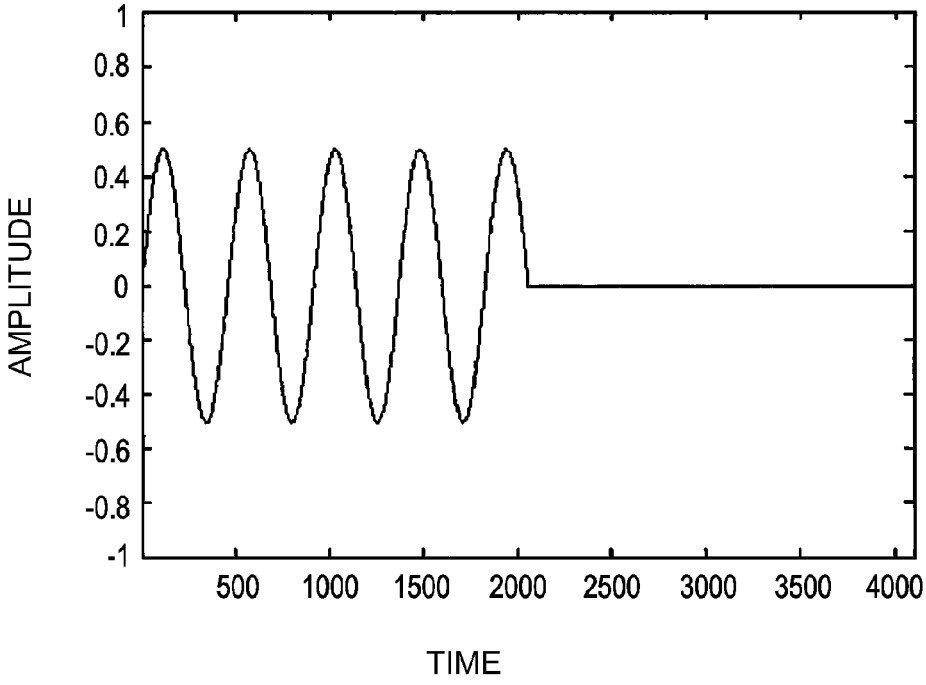
FIG. 3 illustrates an example of a test signal (burst signal of a sine wave)
Figure 4:
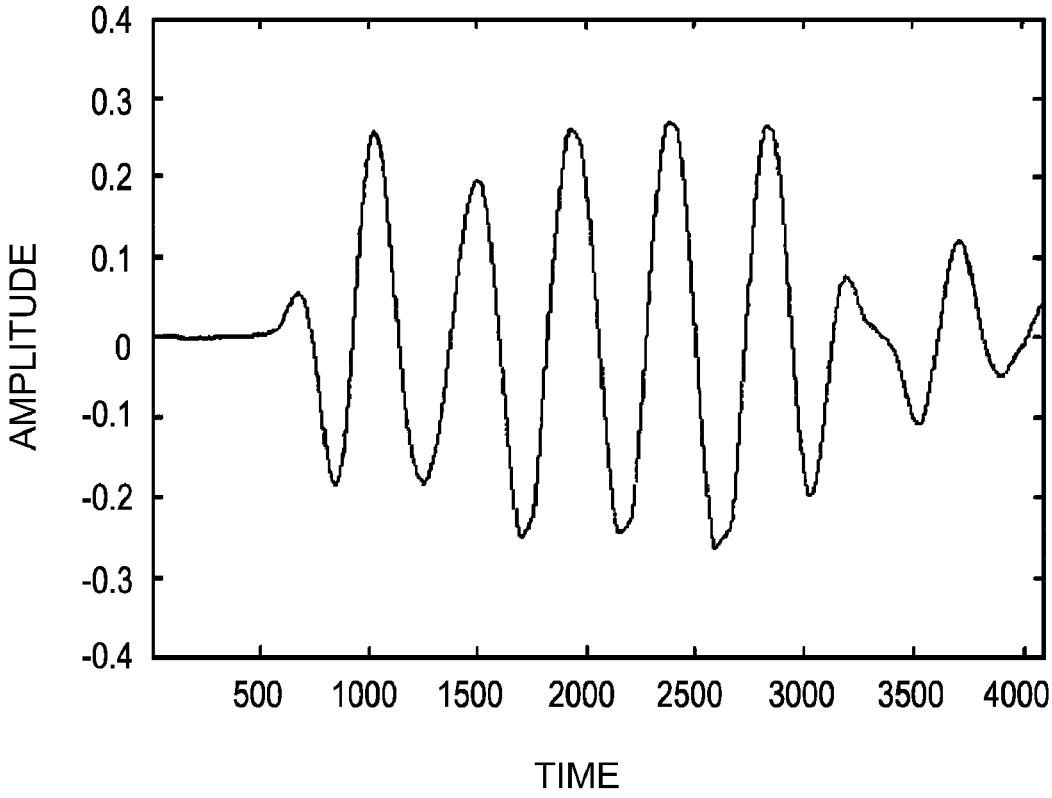
FIG. 4 illustrates an example of a response signal with respect to the test signal of FIG. 3.
Figure 5A:
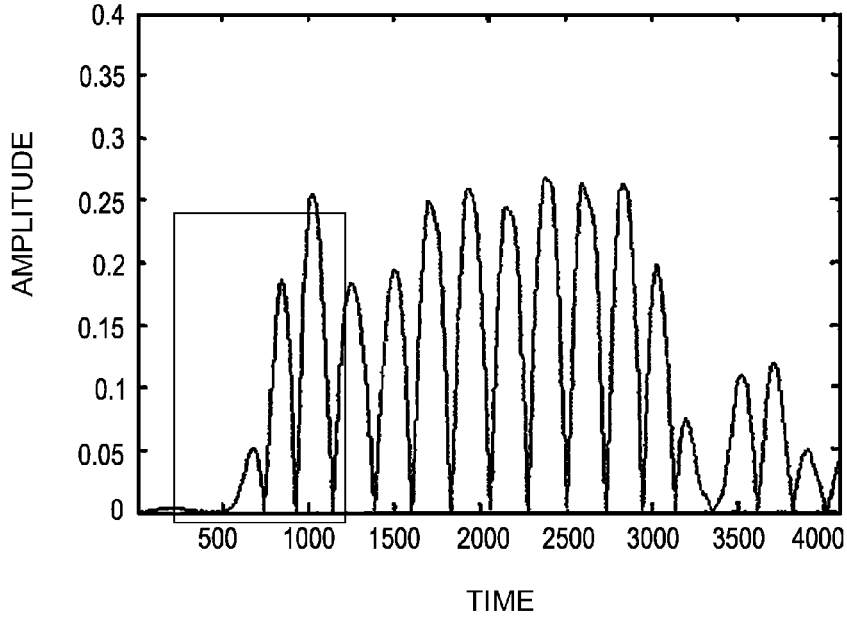
FIGS. 5A and 5B illustrate a waveform to be analyzed, which is obtained by converting the response signal of FIG. 4 into a positive value, and a first transient response part.
Figure 5B:
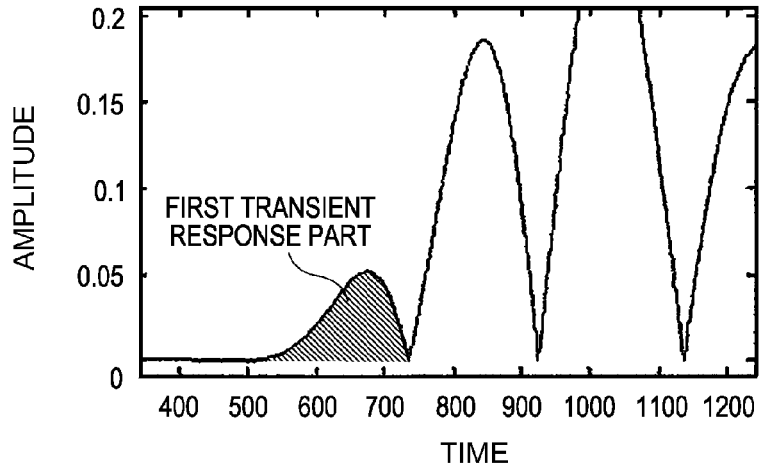

Next, a description is given of the configuration and the operation of parts of the measurement function section 8 in association with the measurement of a woofer time delay. FIG. 2 is a block diagram illustrating a part of the measurement function section 8 in association with the measurement of a woofer time delay. FIG. 3 shows an example of a burst signal of a sine wave, which is a test signal. FIG. 4 shows an example of a response signal obtained by collecting the test signal of FIG. 3. FIGS. 5A and 5B show examples of waveforms of a signal to be analyzed (analysis target waveform), which is formed from the response signal shown in FIG. 4.

As shown in FIG. 2, the parts of the measurement function section 8 in association with the measurement of a woofer time delay include an additional averaging section 81, a filtering section 82, a positive value, conversion section 83, a first transient response selection and determination section 84, and a woofer time delay computation section 85. The first transient response selection and determination section 84 is configured to be capable of referring to the discarding condition list 13. The woofer time delay computation section 85 is configured to be capable of referring to the waveform database 14.

At a stage prior to the additional averaging section 81, a microphone amplifier for amplifying a response signal and an ADC (Analog-Digital Converter) for converting a response signal supplied as an analog signal into a digital signal are provided. However, for the sake of simplicity of description, these parts are omitted herein.

As is also described above, when the execution of a sound field correction process is instructed via the operation section 12, the control section 10 controls the test signal generation section 6, the switch 4, and the power amplifier section 5 so that a burst signal of a sine wave as a test signal, which is generated by the test signal generation section 6, is reproduced from the woofer. This signal is collected by the microphone MC installed at the listening position, and the response signal obtained by sound collection (response signal with respect to the burst signal of a sine wave) is supplied to the additional averaging section 81 of the measurement function section 8.

The additional averaging section 81 performs synchronized additional averaging of a plurality of response signals supplied thereto, increases the SN (Signal to Noise) level of the response signal, and thereafter supplies the response signal to the filtering section 82. When there is no particular problem in the subsequent delay time computation due to the response signal for one time as in the case where the dark noise level in the measurement environment is comparatively low, the synchronized additional averaging process can be omitted. The filtering section 82 performs filtering on the response signal supplied thereto, for example, cuts DC (Direct Current) components and medium to high frequencies that are unnecessary for the woofer, and supplies the response signal after the filtering process to the positive value conversion section 83. For the filtering section 82, a filter having no time-related phase change or having a small phase rotation like a straight-line phase filter should be selected so that the waveform of the response signal is not greatly deteriorated.

The positive value conversion section 83 converts the response signal into a positive value by performing an absolute value conversion process or a squaring process on the response signal supplied thereto. This response signal that is converted into a positive value is a signal used for subsequent analysis and is supplied to the first transient response selection and determination section 84.

An example of an actual waveform is shown below. A test signal (measurement signal) that is generated by the test signal generation section 6 and that is played back from the woofer is formed of, for example, five wavelengths of a sine wave (100 Hz) shown in FIG. 3. As a result of this signal being collected by the microphone MC, a response signal (woofer response waveform) shown in FIG. 4 is obtained.

Of course, as shown in FIG. 3, since the test signal is not such that a sine wave is continued to be played back in a steady manner, the response signal becomes a transient response waveform shown in FIG. 4, and is not converged within five wavelengths due to reverberation in a room. As is also described above, when a filtering process is performed on the response signal shown in FIG. 4 by the filtering section 82 and, for example, an absolute value conversion process is performed thereon by the positive value conversion section 83 in order to convert the response signal into a positive value, a response waveform (absolute value waveform) shown in FIG. 5A is obtained. This waveform shown in FIG. 5A is a waveform to be analyzed at the subsequent stage.

For the sake of convenience, in the waveform to be analyzed (response waveform that is converted into an absolute value) shown in FIG. 5A, a first mountain portion (with respect to time) that can be observed as a response of a burst wave is referred to as a "first transient response part", and subsequent mountain portions are referred to as a "second transient response part", a "third transient response part", . . .

FIG. 5B shows an enlarged waveform of a portion surrounded by a rectangle, and the portion that is filled out black in FIG. 5B is a first mountain portion, that is, a first transient response part.

For the sine wave that becomes a source for the burst wave used as a test signal, in a target speaker, that is, in a woofer in this embodiment, it is preferable that a frequency at which the test signal is considered to be certainly output or a frequency at which the fact that a response at this frequency is not low is confirmed in advance by another measurement means be used.

When the first transient response part is determined, it becomes possible to estimate the rise point on the basis of the waveform thereof, with the result that the woofer time delay can be determined. Therefore, it becomes important to automatically search for the "first transient response part" with respect to the waveform to be analyzed. For example, when the supply of the waveform to be analyzed shown in FIG. 5A is received, the element for selecting and determining the "first transient response part" is the first transient response selection and determination section 84.

Figure 6:
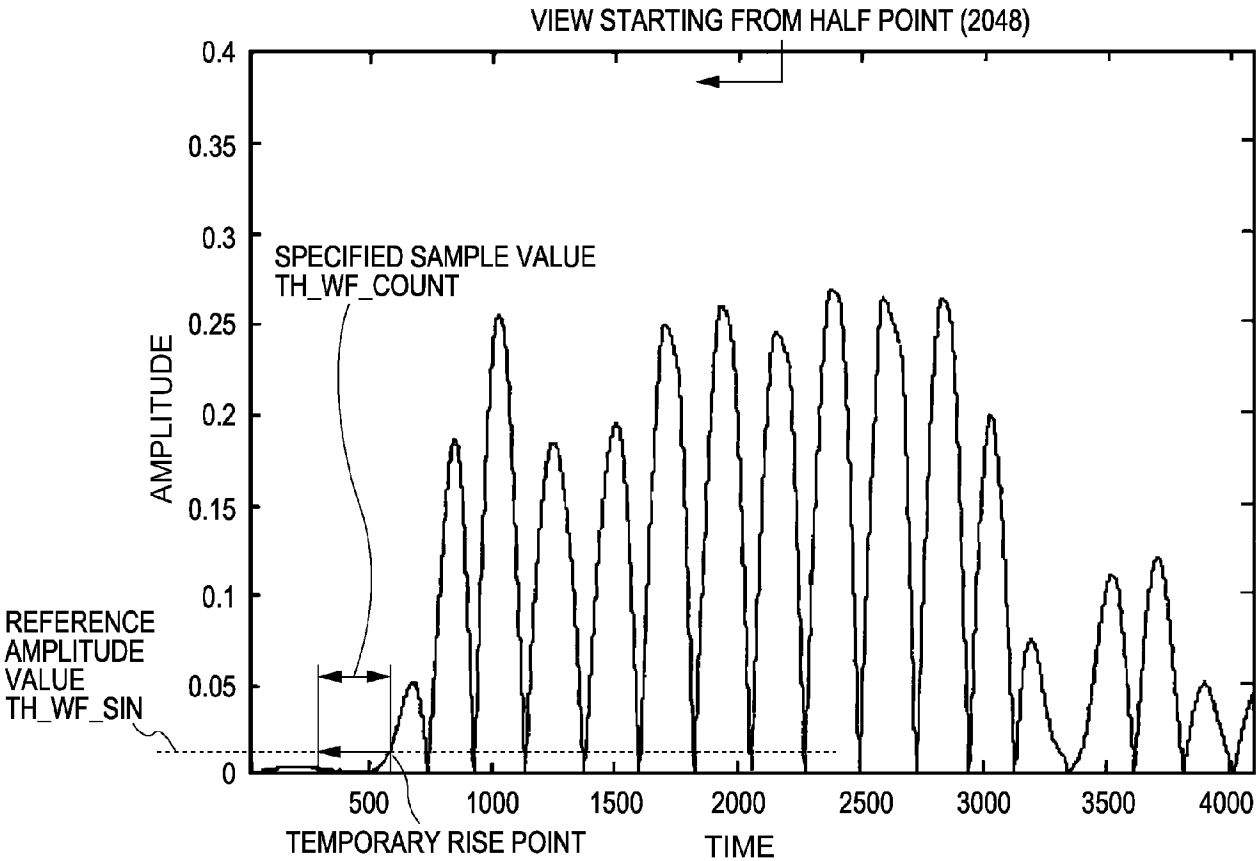
FIG. 6 illustrates a process for analyzing the waveform to be analyzed, which are shown in FIGS. 5A and 5B.

FIG. 6 illustrates a process for selecting and determining a first transient response part used in the first transient response selection and determination section 84 of the playback apparatus of this embodiment, and also shows an example of a waveform to be analyzed, which is supplied to the first transient response selection and determination section 84.

For example, it is assumed that, as shown in FIG. 6, waveforms to be analyzed of 4096 samples are supplied to the first transient response selection and determination section 84. As indicated by the arrow in the upper portion of FIG. 6, the position of the 2048th sample of half of the 4096 samples of the waveforms to be analyzed is made to be a starting point for analysis, and analysis is performed in the previous direction with respect to time (in the direction towards the past).

In this case, when the sampling frequency FS=48 kHz, the woofer time delay corresponding to 2048 samples is 42.6 ms (milliseconds). If the electrical delay within the woofer is set as zero, the spatial delay, that is, the distance that can be measured, becomes approximately 15 m (meter). In the woofer for which measurements are performed, when a time delay longer than or equal to 42.6 ms occurs, measurements cannot be performed. When a time delay longer than the above is assumed on the system side, the sample at the starting point of the analysis and the length of the burst wave on the playback side are changed.

As assumptions for analysis, a parameter TH_WF_SIN, which is an amplitude reference value, is set. The value of the parameter TH_WF_SIN needs to be set to be at least higher than the dark noise level and needs to be set smaller by an amount corresponding to that the waveform can be assumed as a first transient response part. Numeric values herein are numeric values that can be observed within a CPU and a DSP (Digital Signal Processor) that constitute the first transient response selection and determination section 84 via a microphone and an ADC (Analog Digital Converter), which are provided at a stage prior to the additional averaging section 81.

Then, analysis is performed in units of one sample from the position of the 2048th sample, which is a starting point in the manner described above toward the front. In the analysis, when samples previous to the target sample having a value lower than or equal to TH_WF_SIN continues for a number of specified samples (TH_WF_COUNT), as shown in FIG. 6, that position (location) is set as a "temporary rise point".

In the case of the example shown in FIG. 6, the number TH_WF_COUNT of specified samples is set approximately as 100 samples. That is, while a burst wave response exists, it is assumed that the following is known in advance: the number of specified samples does not become greater than or equal to TH_WF_COUNT samples and the data numeric value does not become lower than or equal to the amplitude reference value TH_WF_SIN.

The first mountain waveform, to which the "temporary rise point" belongs, behind with respect to time when viewed from that point, is a candidate for the target "first transient response part" in the first transient response selection and determination section 84. In the manner described above, when a candidate for the first transient response part is selected, several discarding conditions are added to this mountain waveform, so that probability that the selected waveform is the first transient response part that should be determined actually is increased.

If the SN value is originally good, there is no problem even if discarding conditions are not attached. However, in practice, when measurements in a playback environment in a household are considered, there may be cases in which the dark noise level is high and a noise waveform is observed at a time before the first transient response part appears. Furthermore, there may be cases in which, since the woofer is often directly installed on a floor, before a burst signal, which is a reproduced test signal, is propagated through the air and arrives at the microphone MC, vibration that is transmitted from the woofer housing to the floor arrives at the microphone MC and is observed as a waveform.

From the above fact, for example, actual discarding conditions are checked by comparing them with the following discarding conditions with respect to the waveform of the candidate for the determined first transient response part. Examples of the discarding conditions are the following:

(1) The calculation result shows that the woofer time delay is greater or small than an intended time (including a case in which a negative time is calculated with respect to time), (2) The size (area) of the mountain is smaller than an intended size, and (3) The result in which an average inclination of a left shoulder of the mountain is calculated shows that the inclination is smaller than a predetermined value.

The condition (1) is a condition in which, basically, it can be determined that the selection of the first transient response part is in error. The condition (2) is a condition in which noise is prevented from being incorrectly determined as the first transient response part. The condition (3) is a condition in which influences, such as DC components that cannot be removed and vibration that is transmitted via the floor, are prevented.

The above-described discarding conditions (1) through (3) are examples, and it is of course possible that discarding conditions other than those are used and that a plurality of discarding conditions can also be used in combination according to the playback environment for audio, etc. In this embodiment, the discarding conditions are provided in advance, as a databased discarding condition list, in a recording medium 13 such as a memory, to which the first transient response selection and determination section 84 can refer.

In the playback apparatus of this embodiment, as shown in FIG. 1, the discarding condition list 13 is connected to the control section 10, and the first transient response selection and determination section 84 receives and uses the provision of the information of the discarding condition list via the control section 10.

Then, when the discarding conditions (discarding factors) are satisfied, a candidate for the first transient response part is selected again (another candidate for the first transient response part is selected), and the above-described analysis is performed again. Basically, when the discarding conditions are to be discarded, a candidate previous to the first transient response part with respect to time, which should be originally be a correct solution, is often selected. For this reason, for example, improvements are possible by taking action of increasing the amplitude reference value TH_WF_SIN for each loop (each time the candidate for the first transient response part is changed).

However, when this loop is circulated an excessive number of times, that is, when the number of times the candidate for the first transient response part is changed, becomes an excessive number of times, this is a case in which the first transient response part that is assumed to be correct cannot be detected. Thus, a message, such as an error, is displayed to the user, and the measurement of the woofer time delay is given up. Then, for example, after the playback sound field is adjusted, such as the position at which the woofer is installed being changed or the listening position at which the microphone MC is installed being changed, the measurement of the woofer time delay is performed again.

Then, when the first transient response part is correctly selected and is determined as the first transient response part to be analyzed, on the basis of a plurality of sample values of the target first transient response part, the woofer time delay computation section 85 refers to the waveform database 14 that is provided in advance, estimates the rise point of a waveform to be analyzed (burst wave response), and determines the woofer time delay on the basis of the rise point.

In the playback apparatus of this embodiment, as shown in FIG. 1, the waveform database 14 is connected to the control section 10, and the woofer time delay computation section 85 can receive and use the provision of data of the waveform database 14 via the control section 10.

Figure 7:
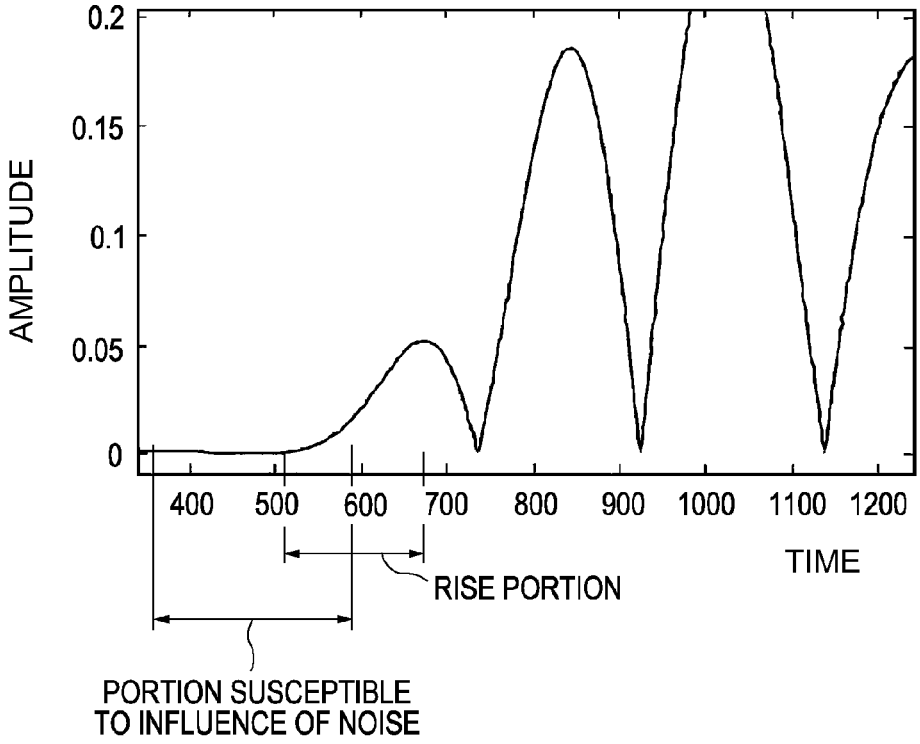
FIG. 7 illustrates the selection of a part used to analyze a waveform to be analyzed.
Figure 8:
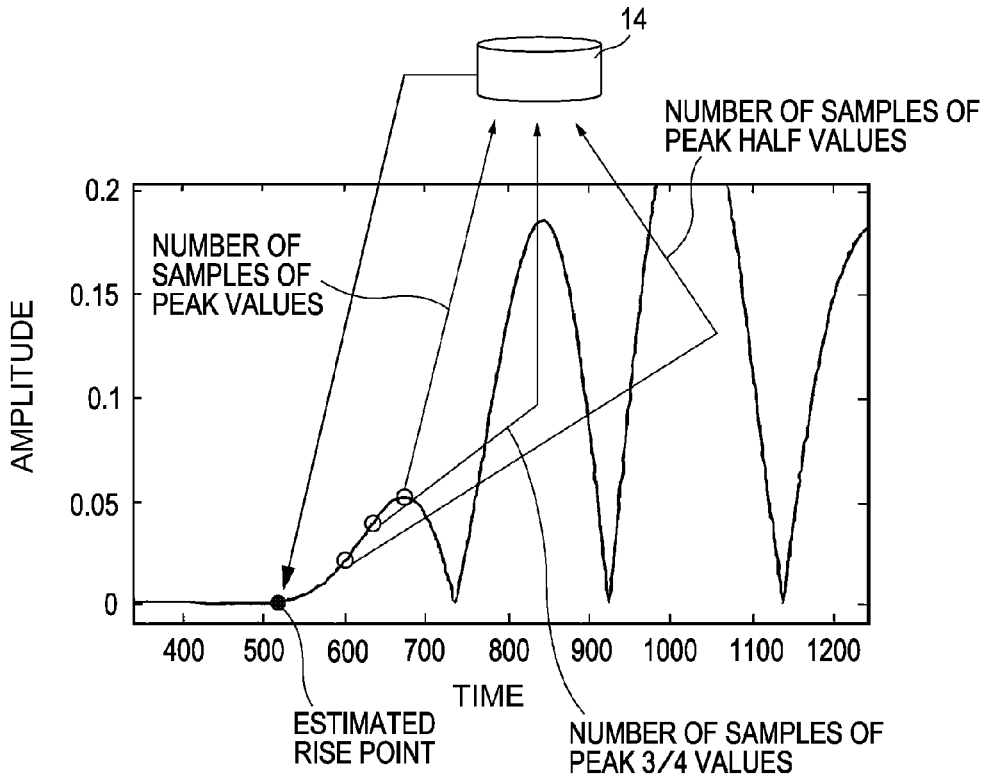
FIG. 8 illustrates an example of determining the rise point of a waveform to be analyzed.

FIG. 7 shows an example of a waveform to be analyzed, which is supplied to the woofer time delay computation section 85. FIG. 8 illustrates an example of estimating the rise point of a waveform to be analyzed. In the waveform to be analyzed shown in FIG. 7, the woofer time delay computation section 85 of this embodiment estimates the rise point by using data of the first transient response part having a small noise influence, which is shown as a rise portion, without using data preceding the first transient response part shown as a portion susceptible to influences of noise.

More specifically, as shown in FIG. 8, for example, the numbers of samples corresponding to the peak value, ½ of the peak value, and ¾ of the peak value of the rise portion, shown in FIG. 7, in which the SN ratio is satisfactory, are determined. The numbers of samples are compared with the information of the waveform database 14 in order to estimate the original rise point.

That is, in the waveform database 14, the correspondence between peak values, ½ of the peak values, and ¾ of the peak values, which are set as index keys, and information indicating rise points, is stored. Of course, a plurality of different index keys and information indicating rise points corresponding to thereto are stored. If a peak value, ½ of the peak value, and ¾ of the peak value are determined, the rise point can be uniquely determined.

Basically, if the waveform to be analyzed (measurement signal) is not complex and playback is limited to a woofer, the waveform database 14 can be formed comparatively simply. Of course, the rise point may also be determined by using a predetermined function in place of the waveform database 14. In addition to an example of a method for determining a rise point will be described later, for example, a regression straight line or a regression curve may be determined on the basis of the above-described plurality of samples/data in order to determine a zero-cross point, or a zero-cross point may be determined by an extrapolation method.

In the manner described above, the woofer time delay computation section 85 can quickly and accurately specify the rise point of the waveform to be analyzed and can compute, as a woofer time delay, the time from the timing at which the test signal is generated up to the target rise point. As a result, the woofer time delay can be quickly and correctly detected, a delay time with respect to the audio channel to which the woofer is connected can be correctly set to the sound field correction section 3, and thus a correct sound field can be formed.

The point to be noted in the measurement of the woofer time delay, which is performed by the playback apparatus of this embodiment, is that the response waveform obtained by collecting a burst signal of a sine wave, which is a test signal, is not formed as a periodic waveform because the response is a transient response as is also described above. For example, even if the peak and the zero-cross value of each "transient response part" having a mountain waveform are observed, they are not periodic, and it is difficult to estimate the original rise point therefrom.

It is also difficult to determine the rise point by using the method identical to the method for estimating the rise point in the impulse response, proposed in, for example, Japanese Patent Application No. 2004-133671, on the basis of a relative value from the maximum value of the waveform. The reason for this is that, unlike the impulse response, since the burst response waveform handled herein is based on low frequencies in which the wavelength is long and is also transient responsive, as shown in FIG. 7, the rise part extends over a long range, and an error in the rise detection becomes larger.

Furthermore, as some of the above-described discarding conditions are necessary, in the rise part of the waveform response in the waveform to be analyzed and the part previous thereto with respect to time, the measurement value may not be stabilized as a result of being affected by the influence of noise and other vibration. Examples of cases in which problems occur in a waveform before the rise point of the waveform to be analyzed in the manner described above are shown in FIGS. 9, 10, and 11.

Figure 9:
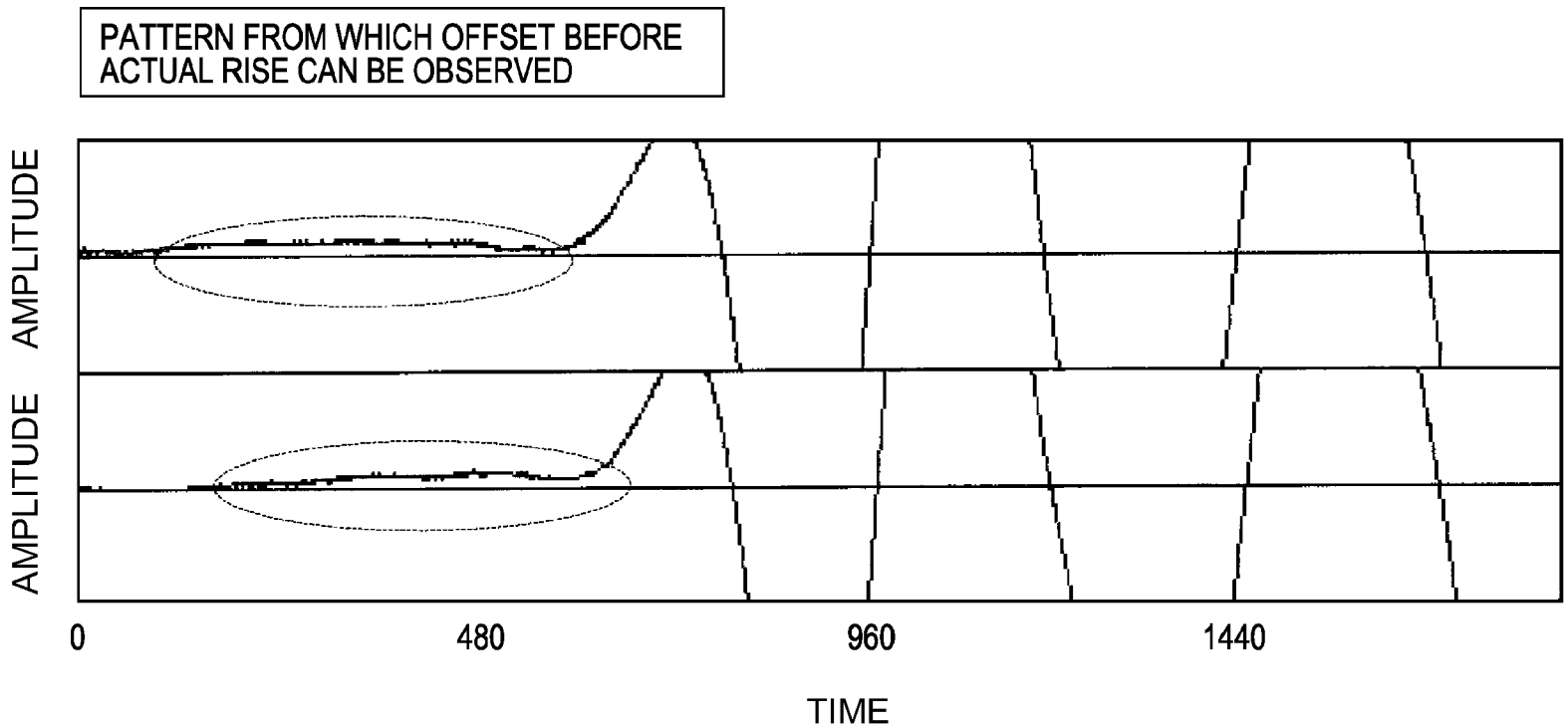
FIG. 9 shows an example of a waveform to be analyzed, in which offset exists before a rise point.
Figure 10:
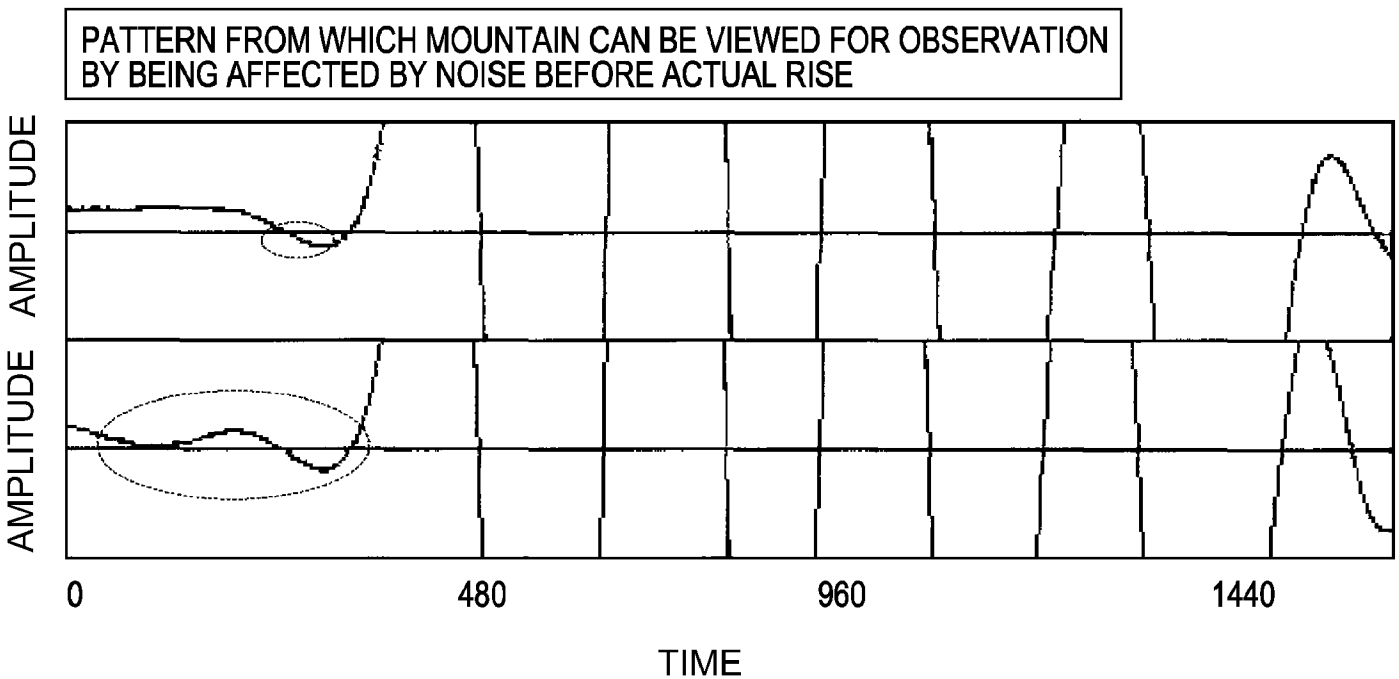
FIG. 10 shows an example of a waveform to be analyzed, in which noise is mixed in before a rise point.
Figure 11:
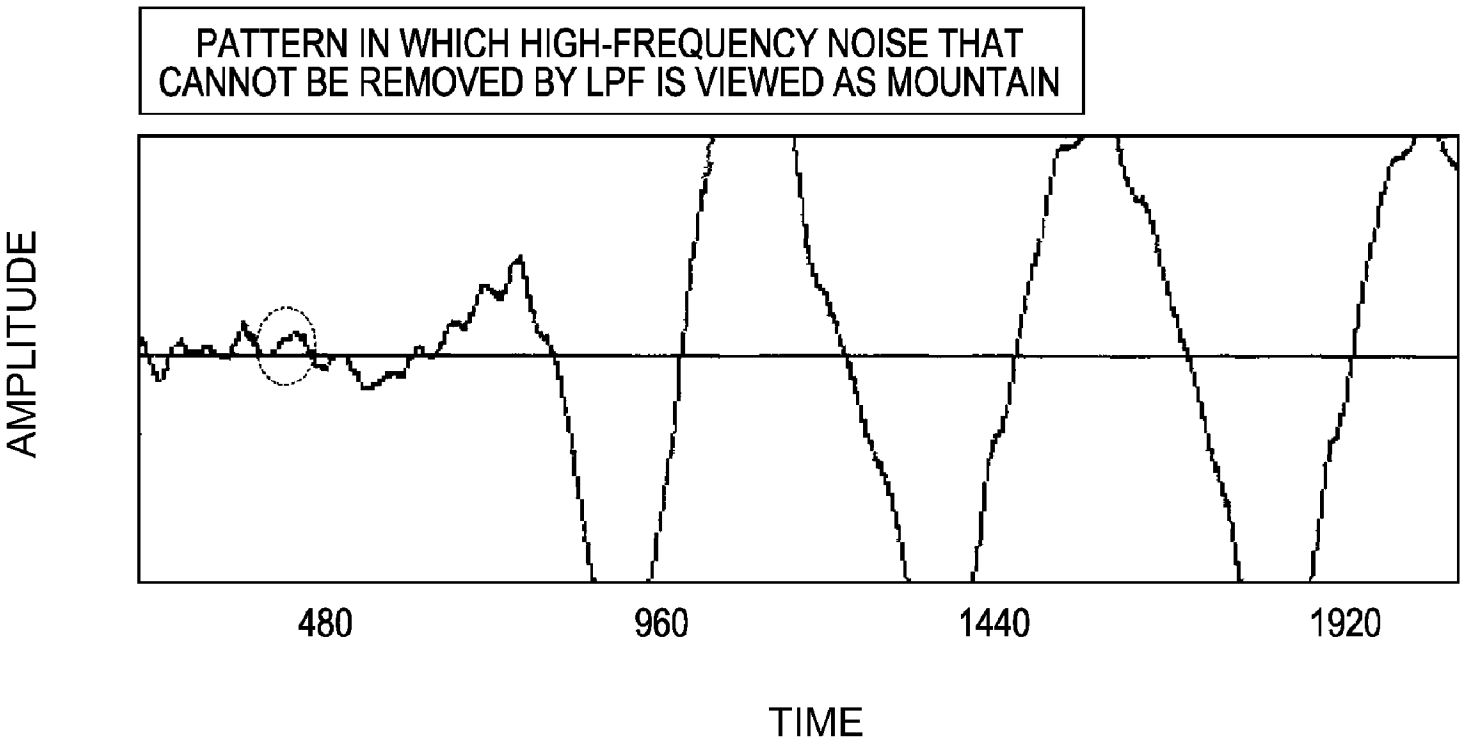
FIG. 11 shows an example of a waveform to be analyzed, in which high-frequency noise that cannot be removed exists.

For example, there may be the following cases. As shown in FIG. 9, an offset occurs before the rise point of the waveform to be analyzed. As shown in FIG. 10, a mountain portion that is likely to be mistaken as a transient response as a result of being affected by noise before the rise point of the waveform to be analyzed occurs. As shown in FIG. 11, high-frequency noise that cannot be removed by an LPF (Low-Pass Filter) causes a mountain portion that is likely to be mistaken as a transient response to occur.

Therefore, in the measurement function section 8 of the playback apparatus of this embodiment, as shown in FIGS. 9, 10, and 11, the rise point is estimated by using sample values in the first transient response part in which the SN ratio is considered to be satisfactory rather than determining the rise point by using data of a portion having a possibility of being greatly affected by influence of an offset and noise (portion having a poor SN ratio).

[Summary of the Operation of the Measurement Function Section]

Figure 12:
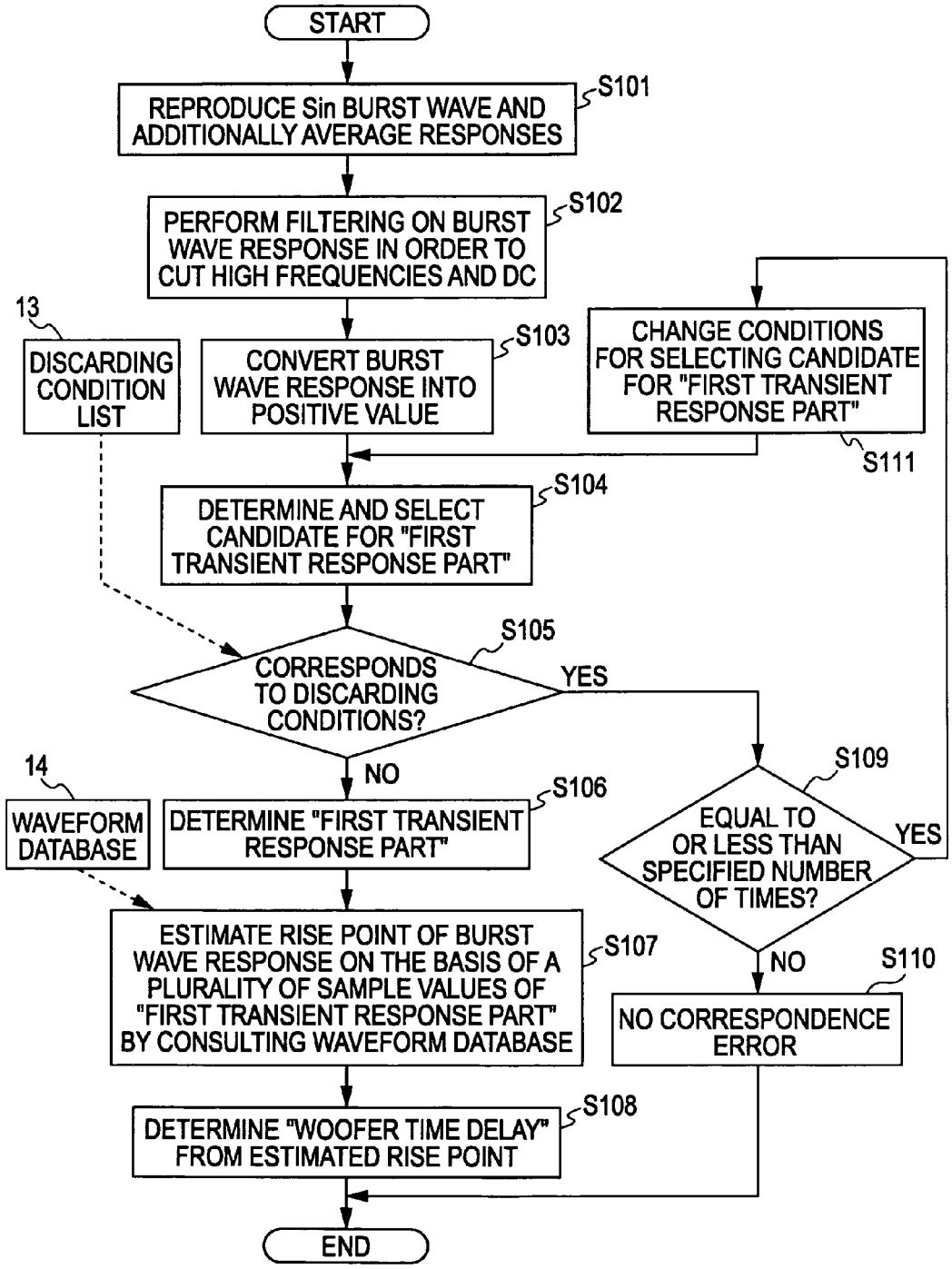
FIG. 12 is a flowchart illustrating the operation of the measurement function section 8.

Next, a description will be given, with reference to the flowchart in FIG. 12, of the operation of the above-described measurement function section 8. The processing in the flowchart shown in FIG. 12 is processing that is performed by the measurement function section 8 under the control of the control section 10 when an execution of a sound field correction process is instructed from a user via the operation section 12.

When an execution of a sound field correction process is instructed from the user, the sound field correction section 3 operates under the control of the control section 10, generates a burst signal of a sine wave, and supplies this signal to the woofer, whereby it is emitted. Therefore, this signal is collected by the microphone MC installed at the listening position, this is supplied to the additional averaging section 81 of the measurement function section 8, whereby an additional averaging process for increasing the SN level is performed (step S101).

Next, a response signal corresponding to the burst signal of a sine wave, which is subjected to the additional averaging process, is supplied to the filtering section 82, whereby filtering for removing noise is performed (step S102). In the filtering section 82, for example, DC components and medium to high frequencies that are unnecessary for the woofer are cut.

Then, the response waveform on which the filtering process is performed is supplied to the positive value conversion section 83, whereby a positive value conversion process is performed (step S103). As described above, the positive value conversion process converts a response signal into a positive value by performing an absolute value conversion process on the response waveform or by performing a squaring process thereon. The signal obtained by converting the response signal into a positive value in this manner is supplied as a waveform to be analyzed, to the first transient response selection and determination section 84. The first transient response selection and determination section 84, as described above, determines and selects a candidate for the first transient response part, which is a first mountain portion of the waveform to be analyzed (step S104).

When the candidate for the first transient response part is selected, it is determined whether or not the selected candidate for the first transient response part corresponds to the discarding conditions by referring to the discarding condition list 13 that is provided in advance (step S105). In the manner described above, some discarding conditions are added to the candidate for the first transient response part, so that the possibility that the determined and selected waveform is the first transient response part that should be determined actually is increased.

In the determination process of step S105, when the selected candidate for the first transient response part does not correspond to predetermined discarding conditions, the selected candidate for the first transient response part is determined as a target first transient response part (step S106). Then, as described with reference to FIG. 8, the woofer time delay computation section 85 estimates the rise point of the response signal in accordance with the information of the waveform database 14 on the basis of a plurality of sampled values of the first transient response part determined in step S106 (step S107). The woofer time delay is computed using this estimated rise point (step S108), and thus the processing shown in FIG. 12 is completed.

When it is determined in the determination process of step S105 that the selected candidate for the first transient response part corresponds to the discarding conditions, it is determined whether or not the number of times processing from step S109 has been performed is smaller than or equal to a predetermined number of times (step S109). In other words, the determination process of step S109 determines whether or not the number of candidates for the first transient response part, which correspond to the discarding conditions, is greater than or equal to a predetermined value.

For this reason, when it is determined in the determination process of step S109 that the number of times processing from step S109 has been performed is not smaller than or equal to a predetermined number of times, this is a case in which the first transient response part cannot be detected normally. Therefore, an error message reporting that the target first transient response part cannot be detected is reported (step S110), and the processing shown in FIG. 12 is then completed.

When it is determined in the determination process of step S109 that the number of times processing from step S109 has been performed is smaller than or equal to a predetermined number of times, the candidate for the first transient response part is changed (step S111). Then, processing starting from step S104 is repeated, and processing for the next first transient response part is performed.

As a result, it is possible for the measurement function section 8 of this embodiment to quickly and accurately specify the rise point of the waveform to be analyzed, which is formed of a response signal in response to a burst signal that is a test signal, and possible to compute, as a woofer time delay, the period of time from the generation timing of the test signal up to the target rise point. Then, on the basis of the computed woofer time delay, the delay time with respect to the audio channel to which the woofer is connected can be correctly set into the sound field correction section 3 and a correct playback sound field can be formed.

In other words, a burst wave formed of continuous sine waves is reproduced as a test signal (measurement signal) from the target speaker (woofer). With respect to a square waveform or an absolute value waveform of the response signal obtained by collecting the signal using a microphone, a "first transient response part", which is a first mountain portion within the waveform, is detected. Then, the "rise point" relating to the target frequency of a sine wave is estimated by using a list or a specific function on the basis of two or more points containing the vicinity of the apex of the detected mountain. This makes it possible to quickly and accurately compute the installation distance up to the microphone and the "woofer time delay" containing the filter delay within the woofer.

The features of this method are that, regarding the measurement signal, in a woofer system having large non-linear characteristics, a response signal with respect to a simple playback signal is directly made to be an analysis waveform. This is particularly effective for a subwoofer having larger non-linear characteristics when compared to an ordinary speaker from the viewpoint of mechanical construction. For example, in the method of impulse response measurement using a TSP, linear characteristics are presupposed with respect to impulse response computation, and there are cases in which the impulse response differs from an actual impulse response. It may be said that the method for measuring a woofer time delay, by which a direct response analysis is performed, is operated more practically.

[Other Methods for Estimating a Rise Point]

Figures 13A, 13B:
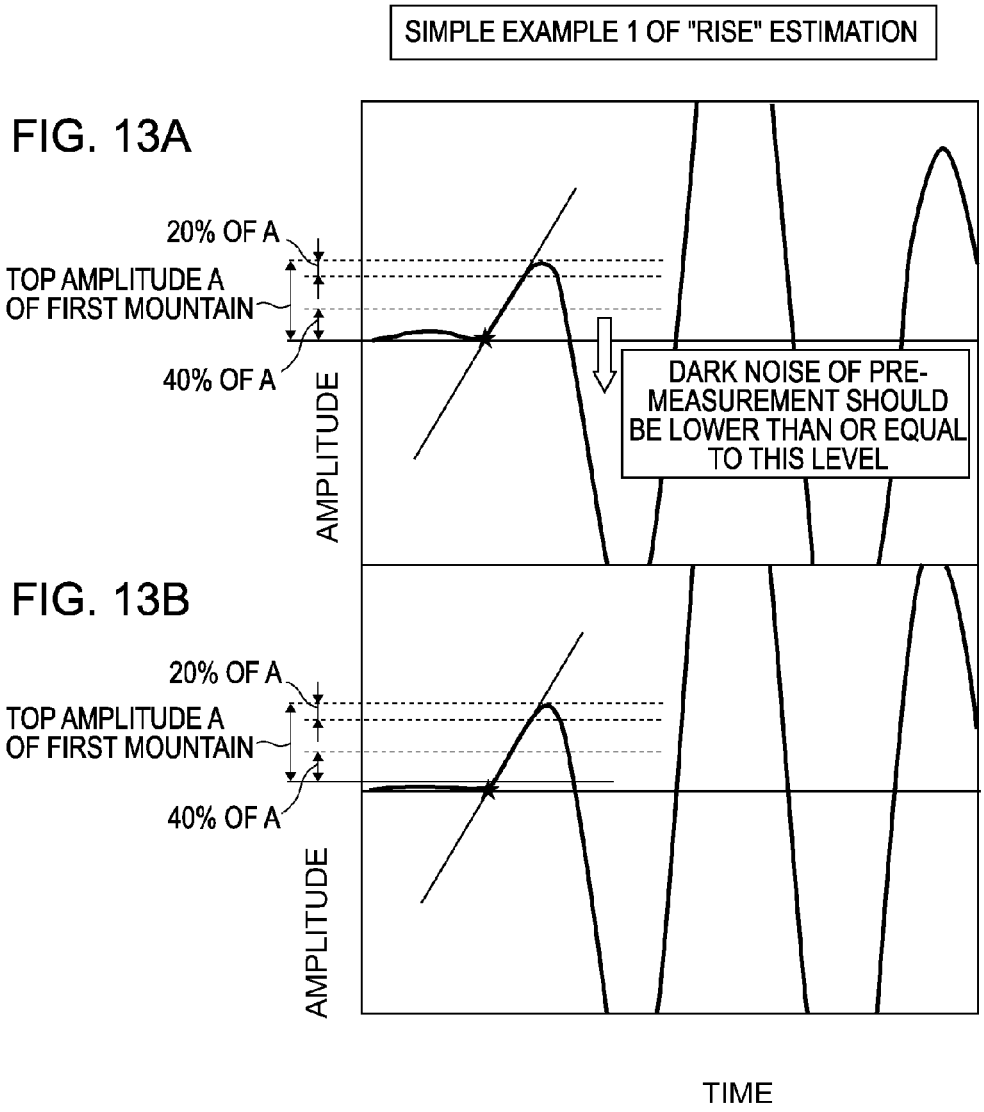
FIGS. 13A and 13B illustrate another method of estimating a rise point.
Figure 14A:
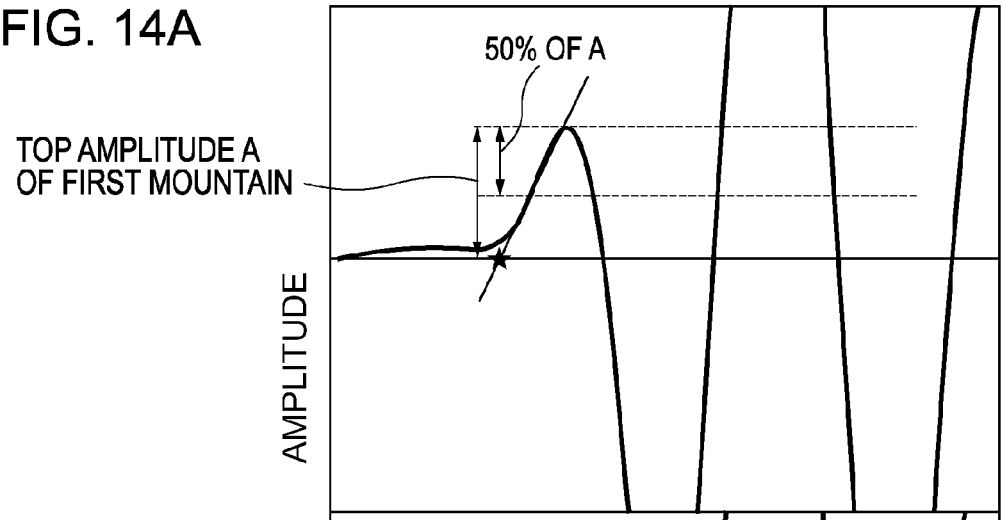
FIGS. 14A and 14B illustrate another method of estimating a rise point.
Figure 14B:
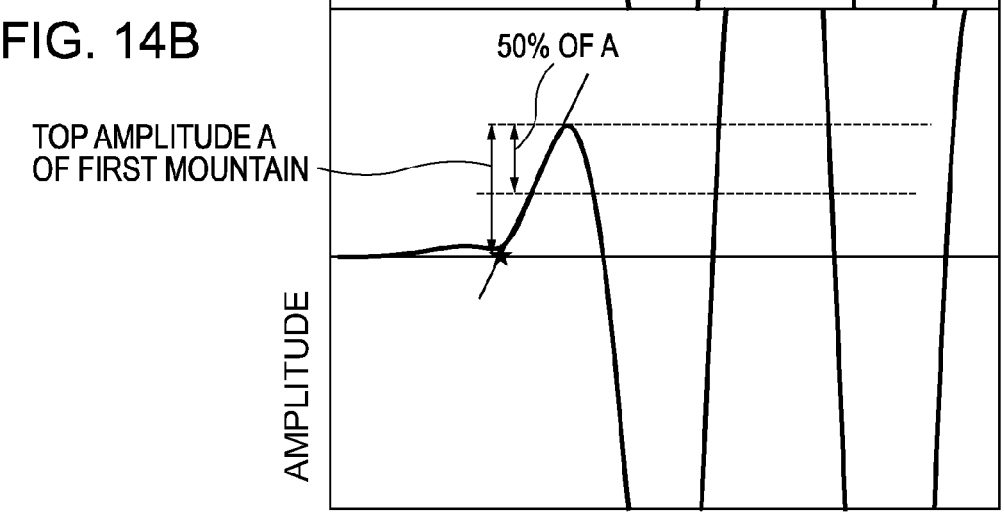
Figure 15:
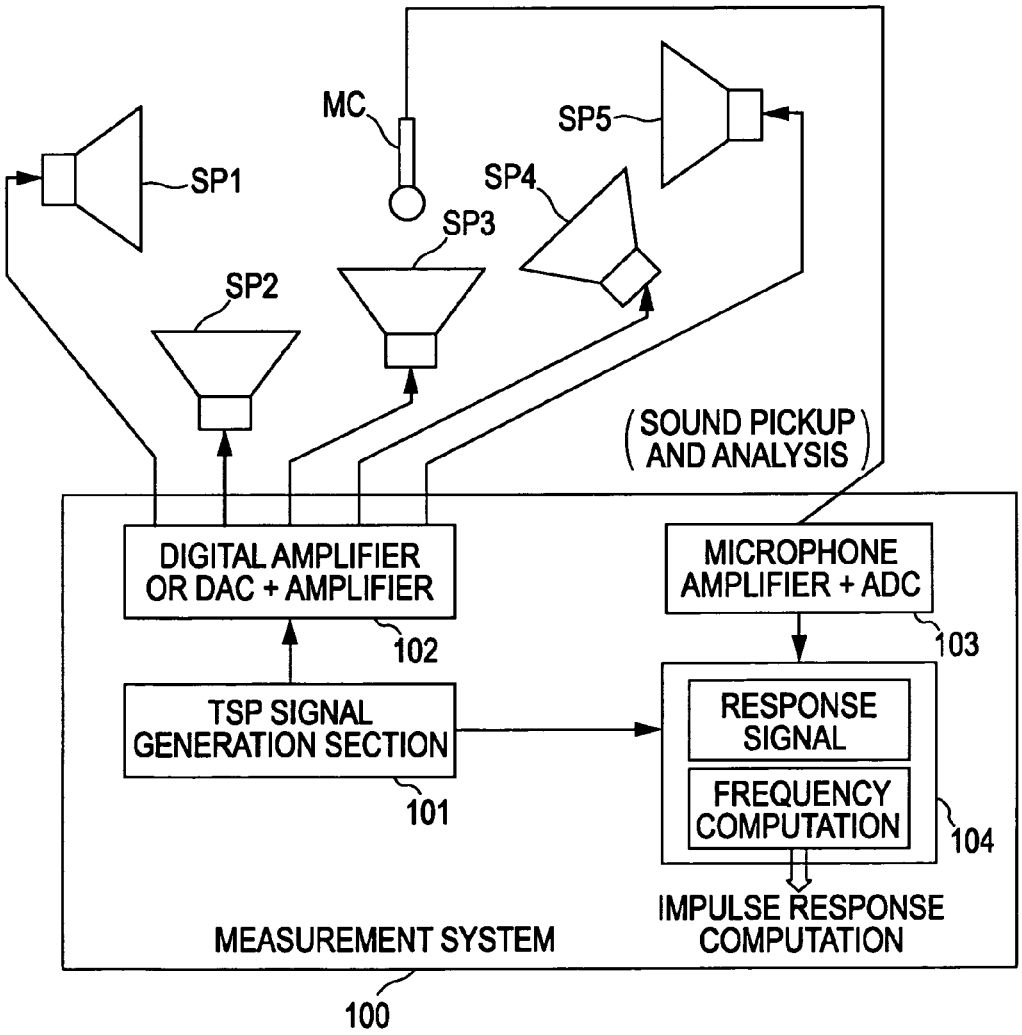
FIG. 15 is a block diagram illustrating an example of a listening system (acoustic system) capable of correcting a sound field.

In the above-described embodiment, a description is given by assuming that the rise point of a waveform to be analyzed is estimated by referring to the waveform database 14 that is provided in advance on the basis of three values, that is, a peak value, ½ of the peak value, and ¾ of the peak value of the first transient response part. However, the present invention is not limited to this example. FIGS. 13 and 14 illustrate another method of estimating a rise point of a waveform to be analyzed.

For example, as shown in parts A and B of FIG. 13, the position at which a straight line passing through a point having a value corresponding to 20 percents from the peak value side of the top amplitude (the amplitude from the value 0 (zero) up to the peak value) of the first transient response part and a point having a value corresponding to 40 percents from the value 0 (zero) side and the horizontal axis of the value 0 (zero) cross each other may be estimated as a rise point.

As shown in part A of FIG. 13, it is preferable that the level of dark noise that is measured in advance (noise measured in a state in which nobody exists in the measurement environment) be a value corresponding to 40 percents from the value 0 (zero) side.

Furthermore, as shown in parts A and B of FIG. 14, in the determined first transient response part, the position at which a straight line passing through a point having a value corresponding to 50 percents from the peak value side of the top amplitude (the amplitude from the value 0 (zero) up to the peak value) of the first transient response part and a point of the peak value or in the very vicinity of the peak value, and the horizontal axis of the value 0 (zero) cross each other may be estimated as a rise point.

In the cases of the examples shown in parts A and B of FIG. 14, if the first transient response part is determined and the position of the peak value thereof can be specified, a straight line connecting the position of the peak value and the point having a value corresponding to 50 percents of the amplitude need only to be determined. Therefore, the rise point can be comparatively easily estimated.

In addition to the examples described with reference to FIGS. 13 and 14, it is also possible to estimate the rise point by using an appropriate ratio with respect to the top amplitude, such as the position at which a straight line passing through a point having a value corresponding to 30 percents from the peak value side of the top amplitude (the amplitude from the value 0 (zero) up to the peak value) of the first transient response part and a point having a value corresponding to 30 percents from the value 0 (zero) side, and the horizontal axis of the value 0 (zero) cross each other being estimated as a rise point on the basis of the top amplitude of the determined first transient response part. That is, on the basis of N (N is an integer of 1 or more) or more points that are determined on the basis of the determined first transient response part, the rise point of the waveform to be analyzed, that is, the rise point of the response signal with respect to the burst signal, which is a test signal, can be estimated.

[Others]

The function as the test signal generation section 6 for generating a burst signal of a sine wave and the function of each section constituting the measurement function section 8 shown in FIG. 2 can of course be implemented by a program to be executed by the control section 10. That is, a program for performing processing described with reference to the flowchart in FIG. 12 is formed and this program is executed in the control section 10. Thus, the function as the measurement function section 8 is realized by the control section 10, so that the woofer time delay with respect to the woofer can be measured and appropriately corrected.

In the above-described embodiment, a burst signal of a sine wave of 100 Hz is used as a test signal, but the present invention is not limited to this example. In terms of a frequency, a signal having a frequency of 100 Hz or in the vicinity thereof, which is a signal meaningful to the woofer, or a signal having a frequency of several tens of Hz to several hundreds of Hz and on which a time window is superposed so as to have a predetermined time width as in the above-described burst signal, may be used as a test signal. The superposition of the time window can be performed by superposing a rectangular wave (pulse signal) having a fixed time width. The burst signal is not limited to a plurality of sine waves, and may be only one sine wave. Furthermore, a sine wave of a half wave can also be used if response characteristics of the speaker are satisfactory.

In the playback apparatus of the above-described embodiment, it is described that both the determination of the first response part and the process for estimating the rise point of a waveform to be analyzed are performed by the woofer time delay computation section 85 of the measurement function section 8, but the present invention is not limited to this example. The determination of the first response part and the process for estimating the rise point of a waveform to be analyzed can also be performed by different parts correspondingly.

In the playback apparatus of the above-described embodiment, it is described that the woofer time delay computation section 85 of the measurement function section 8, as described with reference to FIG. 8, performs analysis staring from a predetermined position in the time direction of the waveform to be analyzed towards a direction of going back in time, but the present invention is not limited to this example. The analysis may of course be performed in the direction of time passage from a predetermined position before the rise point.

All the time length of the response signal, the sampling frequency thereof, the reference position of analysis thereof, and the like used in the above-described embodiment are only examples, and are of course not limited to those values.

In the playback apparatus of the above-described embodiment, a description is given by using as an example a case in which the present invention is applied to a playback apparatus capable of playing back an optical disc such as a DVD, but the present invention is not limited to this example. The present invention can also be applied to a personal computer and various kinds of playback apparatuses capable of reproducing audio signals, a recording and playback apparatus, an audio device such as an audio amplifier.

In the above-described embodiment, a description is given by using as an example a case in which multi-channel audio of a 5.1 channel is played back, but the present invention is not limited to this example. The present invention can also be applied to a case in which the woofer time delay of audio emitted from a speaker for low audio frequencies, such as a woofer or a subwoofer, is to be measured.

It should be understood by those skilled in the art that various modifications, combinations, sub-combinations and alterations may occur depending on design requirements and other factors insofar as they are within the scope of the appended claims or the equivalents thereof.

The invention claimed is:

1. An acoustic apparatus, comprising:

positive value conversion means for converting a response signal into a succession of positive-valued peaks, the response signal being obtained by collecting a test signal using a microphone, the test signal being emitted from a speaker;

detection means for detecting a first transient response part by (a) selecting a first one of the succession of positive-valued peaks of the converted response signal as a first transient response part candidate, (b) determining whether the first transient response part candidate conforms to one or more discarding conditions, and (c) establishing the first transient response part candidate as the first transient response part in response to determining that the first transient response part candidate does not conform to the one or more discarding conditions, and in response to determining that the first transient response part candidate conforms to the one or more discarding conditions, selecting a portion of another converted response signal as the first transient response part candidate and repeating (b) and (c);

estimation means for estimating a rise point of the converted response signal from at least N sampling points, wherein N is a positive integer, that contain a peak position of the first transient response part or the vicinity thereof; and computation means for computing a time delay of audio collected by the microphone based on the estimated rise point and on a timing at which the test signal is generated.

2. The acoustic apparatus according to claim 1, wherein the speaker for emitting the test signal is used for low audio frequencies.

3. The acoustic apparatus according to claim 1, wherein the estimation means estimates the rise point by referring to list information formed of a plurality of pieces of information in which two or more of the N points correspond to the rise point.

4. The acoustic apparatus according to claim 1, wherein the estimation means estimates the rise point based on a predetermined function in which the rise point is determined in accordance with two or more of the N points.

5. A time delay computation method, comprising:

emitting a test signal from a speaker;

collecting the emitted test signal using a microphone;

converting, into a succession of positive-valued peaks, a response signal obtained by collecting the emitted test signal;

detecting a first transient response part by (a) selecting a first one of the succession of positive-valued peaks of the converted response signal as a first transient response part candidate, (b) determining whether the first transient response part candidate conforms to one or more discarding conditions, and (c) establishing the first transient response part candidate as the first transient response part in response to determining that the first transient response part candidate does not conform to the one or more discarding conditions, and in response to determining that the first transient response part candidate conforms to the one or more discarding conditions, selecting portion of another converted response signal as the first transient response part candidate and repeating (b) and (c);

estimating a rise point of the converted response signal from at least N sampling points, wherein N is a positive integer, that contain a peak position of the first transient response part or the vicinity thereof; and computing a time delay of audio collected by the microphone based on the estimated rise point and on a timing at which the test signal is generated.

6. A non-transitory recording medium having recorded thereon a computer program having instructions for carrying out time delay computation method, the method comprising:

emitting a test signal from a speaker;

collecting the emitted test signal using a microphone;

converting, into a succession of positive-valued peaks, a response signal obtained by collecting the emitted test signal;

detecting a first transient response part by (a) selecting a first one of the succession of positive-valued peaks of the converted response signal as a first transient response part candidate, (b) determining whether the first transient response part candidate conforms to one or more discarding conditions, and (c) establishing the first transient response part candidate as the first transient response part in response to determining that the first transient response part candidate does not conform to the one or more discarding conditions, and in response to determining that the first transient response part candidate conforms to the one or more discarding conditions, selecting portion of another converted response signal as the first transient response part candidate and repeating (b) and (c);

estimating a rise point of the converted response signal from at least N sampling points, wherein N is a positive integer, that contain a peak position of the first transient response part or the vicinity thereof; and computing a time delay of audio collected by the microphone based on the estimated rise point and on a timing at which the test signal is generated.

7. An acoustic apparatus, comprising:

a hardware control section configured to (i) convert a response signal into a succession of positive-valued peaks, the response signal being obtained by collecting a test signal using a microphone, the test signal being emitted from a speaker, (ii) detect a first transient response part by (a) selecting a first one of the succession of positive-valued peaks of the converted response signal as a first transient response part candidate, (b) determining whether the first transient response part candidate conforms to one or more discarding conditions, and (c) establishing the first transient response part candidate as the first transient response part in response to determining that the first transient response part candidate does not conform to the one or more discarding conditions, and in response to determining that the first transient response part candidate conforms to the one or more discarding conditions, selecting portion of another converted response signal as the first transient response part candidate and repeating (b) and (c), (iii) estimate a rise point of the converted response signal from at least N sampling points, wherein N is a positive integer, that contain a peak position of the first transient response part or the vicinity thereof, and (iv) compute a time delay of audio collected by the microphone based on the estimated rise point and on a timing at which the test signal is generated.

8. The time delay computation method according to claim 5, wherein the speaker for emitting the test signal is used for low audio frequencies.

9. The time delay computation method according to claim 5, wherein the estimating step estimates the rise point by referring to list information formed of a plurality of pieces of information in which two or more of the N points correspond to the rise point.

10. The time delay computation method according to claim 5, wherein the estimating step estimates the rise point based on a predetermined function in which the rise point is determined in accordance with two or more of the N points.

11. The non-transitory recording medium according to claim 6, wherein the speaker for emitting the test signal is used for low audio frequencies.

12. The non-transitory recording medium according to claim 6, wherein the estimating step estimates the rise point by referring to list information formed of a plurality of pieces of information in which two or more of the N points correspond to the rise point.

13. The non-transitory recording medium according to claim 6, wherein the estimating step estimates the rise point based on a predetermined function in which the rise point is determined in accordance with two or more of the N points.

14. The acoustic apparatus according to claim 7, wherein the speaker for emitting the test signal is used for low audio frequencies.

15. The acoustic apparatus according to claim 7, wherein the estimation means estimates the rise point by referring to list information formed of a plurality of pieces of information in which two or more of the N points correspond to the rise point.

16. The acoustic apparatus according to claim 7, wherein the estimation means estimates the rise point based on a predetermined function in which the rise point is determined in accordance with two or more of the N points.

* * * * *